United States Patent [19]

Bodnar et al.

[11] Patent Number: 4,458,250

[45] Date of Patent: Jul. 3, 1984

[54] 360-DEGREE SCANNING ANTENNA WITH CYLINDRICAL ARRAY OF SLOTTED WAVEGUIDES

[75] Inventors: Donald G. Bodnar, Atlanta, Ga.; James W. Cofer, Jr., Indialantic, Fla.

[73] Assignee: The United States of America as represented by the Secretary of the Navy, Washington, D.C.

[21] Appl. No.: 271,056

[22] Filed: Jun. 5, 1981

[51] Int. Cl.[3] ..... H01Q 13/10

[52] U.S. Cl. ..... 343/768; 343/771

[58] Field of Search ..... 343/761, 768, 771, 783, 343/786

[56] References Cited

U.S. PATENT DOCUMENTS

| | | | |
|---|---|---|---|
| 2,653,239 | 8/1953 | Chu et al. | 343/786 |
| 2,836,822 | 5/1958 | Ehrlich et al. | 343/771 |
| 3,072,905 | 1/1963 | Wilkes | 343/785 |
| 3,230,535 | 1/1966 | Ferrante et al. | 343/786 |

*Primary Examiner*—Eli Lieberman

*Attorney, Agent, or Firm*—Robert F. Beers; Ervin F. Johnston; Harvey Fendelman

[57] ABSTRACT

A 360 degree scanning antenna is disclosed which includes a mechanism for scanning the main beam of a cylindrical array in azimuth and over a limited angle in elevation in which a primary feedhorn illuminates a geodesic lens which in turn illuminates the cylindrical array structure. Energy is coupled from the parallel plate structure of the feedhorn assembly into the individual waveguides of the array via dielectric wedges extending from the waveguides.

Scanning in elevation is accomplished by changing the transmitter frequency and in azimuth by rotating the primary feedhorn assembly.

12 Claims, 11 Drawing Figures

360-DEGREE SCANNING ANTENNA WITH CYLINDRICAL ARRAY OF SLOTTED WAVEGUIDES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to the field of antennas and antenna arrays and, more specifically, to the field of waveguide radiating antenna arrays and to such arrays having the capability of beam scanning in both elevation and azimuth. Scanning of cylindrical array antennas is currently accomplished by use of phase shifters for each element of the array or by use of a corporate feed network. The use of phase shifters to provide scanning requires the use of complex circuitry and is very expensive. Corporate feed networks are extremely difficult to build and are extremely difficult to achieve impedance matching.

SUMMARY OF THE INVENTION

In accordance with the present invention a device is disclosed for scanning the main beam of a cylindrical antenna array in azimuth and over a limited angle in elevation without the use of phase shifters or a corporate feed network. The mechanism utilized in the present invention to overcome the difficulties encountered with the prior art techniques is extremely simple and relatively inexpensive.

The problems of the prior art techniques are obviated in accordance with the present invention by use of dielectric transitions to the waveguides to reduce system complexity and further by the use of a mechanically rotated feedhorn assembly to produce azimuth scanning of the beam. Elevation scanning of the beam is accomplished by changing the transmitter frequency.

In accordance with the present invention a primary feedhorn assembly including a geodesic lens illuminates the cylindrical waveguide antenna array structure. Energy is coupled from the parallel plate structure of the lens into the individual waveguides of the antenna array via dielectric wedges which extend from the waveguides into the parallel plate structure of the feedhorn assembly.

OBJECTS OF THE INVENTION

It is the primary object of the present invention to disclose a novel scanning antenna assembly which provides for scanning of the main beam of a cylindrical array in azimuth and over a limited angle in elevation without the use of phase shifters or corporate feed networks.

It is a further object of the present invention to disclose a novel 360 degree scanning waveguide antenna in which scanning in azimuth is accomplished by rotating of the primary feedhorn assembly with respect to the radiating cylindrical waveguide antenna structure.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
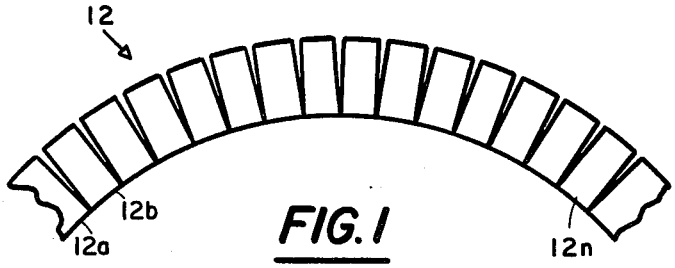
FIG. 1 is a top view of a section of a cylindrical waveguide antenna wherein the radiating surfaces are in the narrow walls or edges of the waveguide elements.
Figure 2:
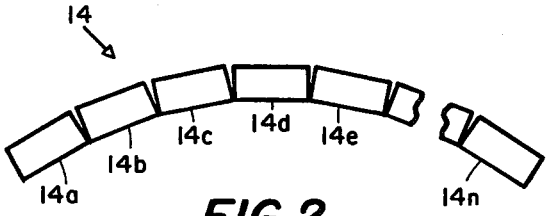
FIG. 2 is a top view of a section of a cylindrical waveguide antenna array wherein the elctromagnetic energy is radiated out the broadwalls of the waveguide elements.

An edge slot array 12 as illustrated in FIG. 1 consists of a series of waveguides 12*a*, 12*b*, . . . , 12*n* with the broadwalls of each of the waveguides stacked one beside the other as illustrated in FIG. 1. Slots are cut into the outer narrow wall of the waveguide and typically wrap around into the broadwall sides of the waveguide. As further described below, the edge slot array illustrated in FIG. 1 may be used in the present invention. Alternately, and preferably for purposes of the present invention, a broadwall slotted array 14 as illustrated in FIG. 2 may be used and consists of a group of waveguides 14*a*, 14*b*, 14*c*, 14*d*, 14*e*, . . . , 14*n* with the narrow walls of waveguides touching one another. The broadwall slotted array as illustrated in FIG. 2 requires fewer waveguides to form the cylindrical array than with the edge walls slotted array and therefore is considered to be preferable for use in the present invention. Moreover, the array as illustrated in FIG. 2 will be lighter than an edge slot array due to the fact that fewer waveguide elements are required. However, it is important for radiation pattern constraints to consider the peripheral spacing between slots, and this spacing is more critical for the broadwall design.

Figure 3:
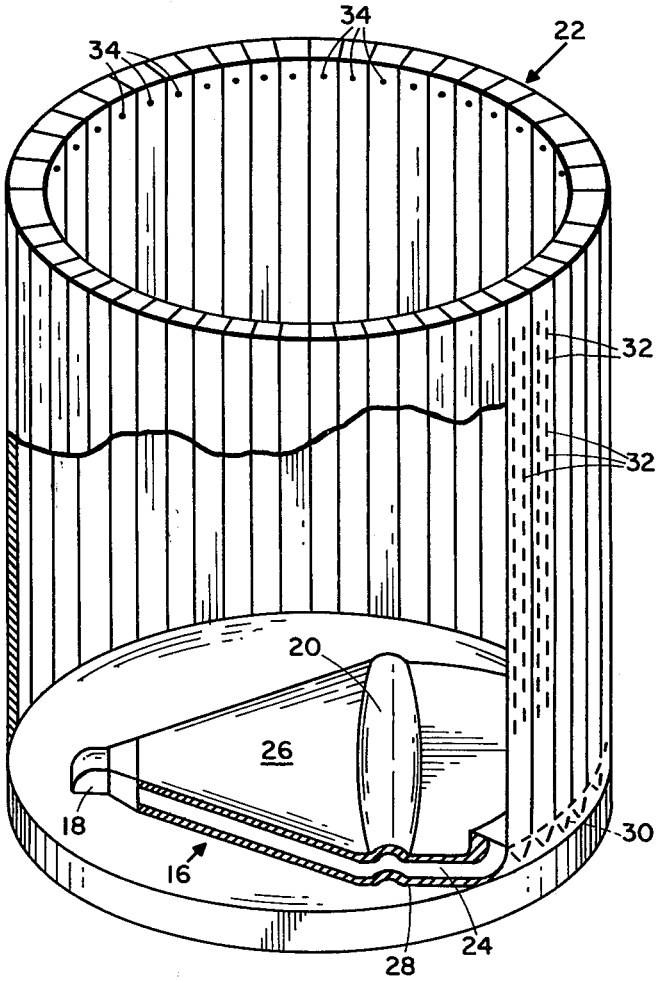
FIG. 3 is an isometric illustration of the cylindrical antenna array in accordance with the present invention.
Figure 7A:
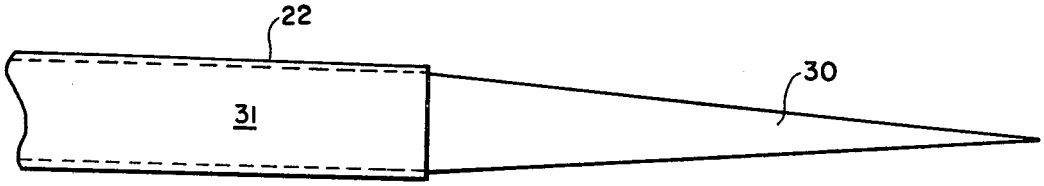
FIG. 7*a* is a partial front view of the bottom portion of a broadwall radiating waveguide 22 such as waveguide 14*a* illustrated in FIG. 2, showing the dielectric wedge construction of the present invention used for coupling the waveguide to the feed assembly.
Figure 7B:
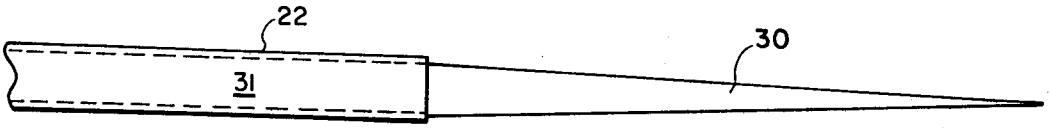
FIG. 7*b* is a partial side view of the bottom portion of a broadwall radiating waveguide 22 such as waveguide 14*a* illustrated in FIG. 1, showing the dielectric wedge construction of the present invention used for coupling the waveguide to the feed assembly.
Figure 8:
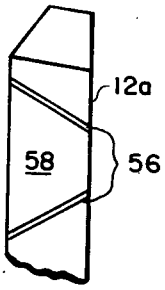
FIG. 8 is a perspective view of a portion of waveguide 12*a* of FIG. 1 which has its radiating slots formed in the narrow walls of the radiating waveguide structure.
Figure 9A:
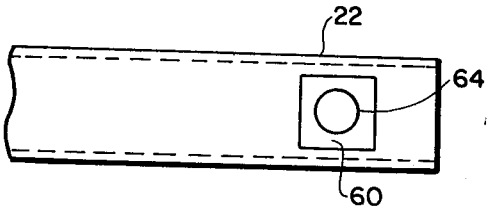
FIG. 9*a* is a partial back view of a broadwall radiating waveguide 22 of the present invention illustrating the details of the waveguide load.
Figure 9B:
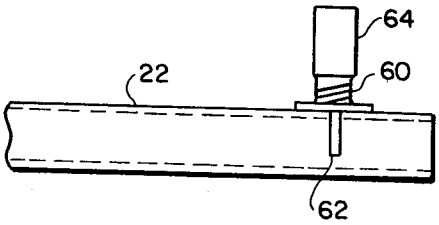
FIG. 9*b* is a partial side view of a broadwall radiating waveguide 22 of the present invention illustrating the details of the waveguide load.

The basic geometry of the cylindrical array configuration of the present invention is illustrated in FIG. 3 and will now be described. It consists of a primary feedhorn assembly 16 which includes a primary feedhorn 18 illuminating a geodesic lens 20 which in turn illuminates the cylindrical array structure 22. The cylindrical array structure 22 may comprise either the edge slot array as illustrated in FIG. 1 or preferably, the broadwall slotted array as illustrated in FIG. 2. For certain applications the waveguide may be disposed on a conical as well as cylindrical surface. The feedhorn assembly 16 is embodied as a parallel plate structure 24 which includes a top plate 26 and bottom plate 28. Energy is coupled from the output of the parallel plate structure 24 from the geodesic lens 20 into the individual waveguide elements by means of dielectric wedges 30 extending out from the waveguides and into the parallel plate structure 24. The dielectric wedges 30 extend out from the bottoms of their respective waveguides 22 from dielectric fillings 31 as can be seen more clearly in the front and side views of FIGS. 7*a* and 7*b*, respectively. Energy is radiated from the waveguides to free space through broadwall slots 32 illustrated for the sake of simplicity in only two of the illustrated waveguide elements 22. It is to be understood, however, that each of the waveguide elements 22 would likewise be provided with radiating slots 32. Alternatively, where narrow wall radiating waveguides 12 are used in lieu of broadwall radiating waveguides 14, each of the waveguides 12 may be provided with radiating slots 56 formed in their narrow walls 58 as is depicted in FIG. 8. The antenna beam of the present invention is scanned in azimuth by rotating the primary feedhorn assembly 16 and the geodesic lens 20 as a unit. Scanning in elevation is accomplished by changing the frequency of the transmitter. A portion of the energy in each of the waveguides must be dissipated in a load at the top of each waveguide because a travelling wave array design is used. This can be accomplished either with waveguide or coaxial loads 34 as illustrated. FIGS. 9*a* and 9*b* illustrate the coaxial loads 34 in greater detail. As can be seen in FIGS. 9*a* and 9*b*, a standard SMA coaxial connector 60 has its center conductor 62 extending into the waveguide 22 as a probe and has another coaxial connector 64 connected to it at its other end, this coaxial connector 64 containing the waveguide "load" as is well known.

Figure 4:
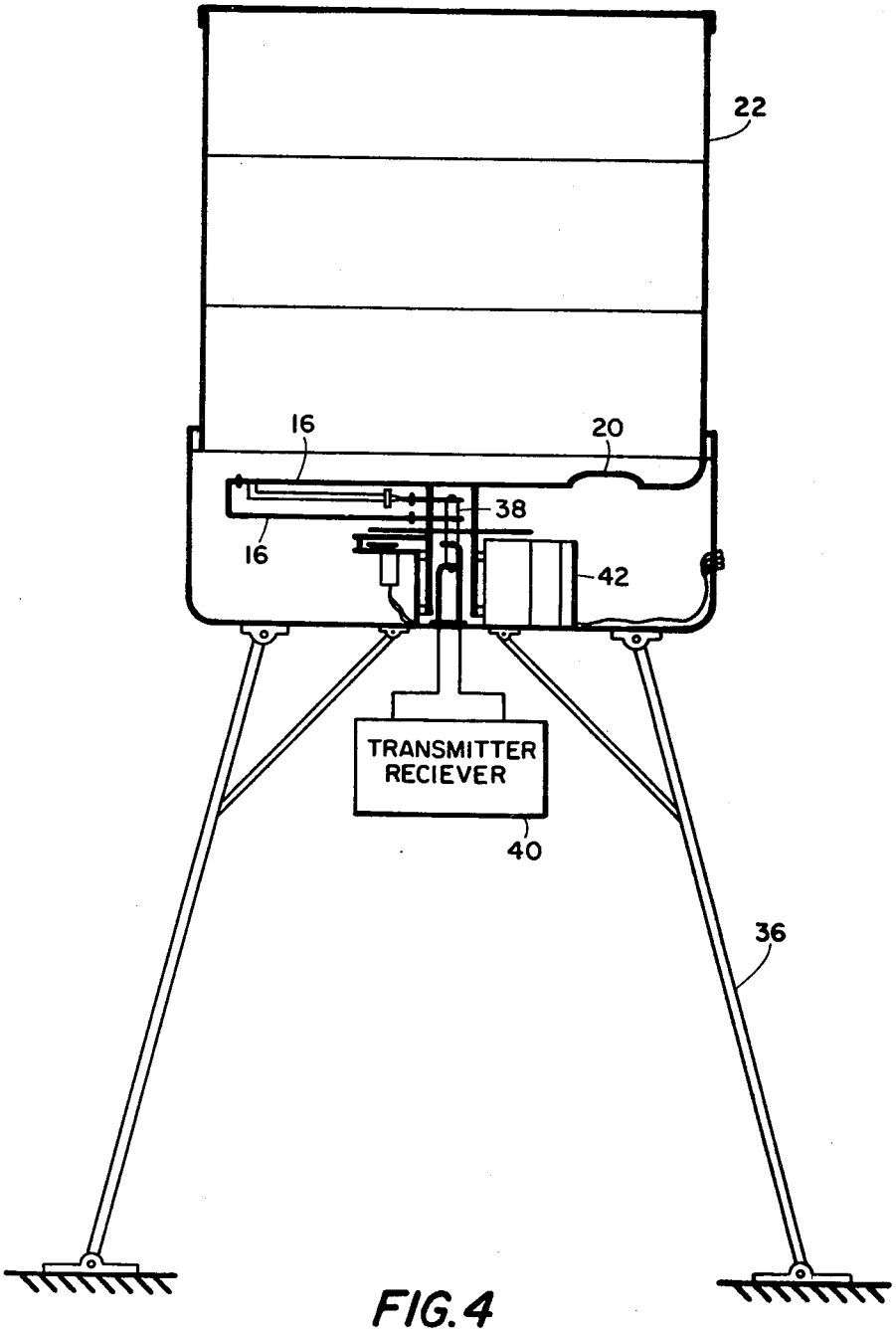
FIG. 4 is a partially cut away side view of the 360 degree scanning antenna in accordance with the present invention.

Referring to FIG. 4 there is illustrated a partially cutaway view of the cylindrical waveguide array configuration of FIG. 3 mounted on an antenna stand 36 and including for purposes of illustration of the invention auxillary components that typically would be used in conjunction with the present invention. More specifically, the waveguide array 22, as stated above is mounted on an antenna support stand 36. A rotary joint 38 is coupled to the rotating feed assembly 16 and preferably is a dual-channel joint specifically tuned for the frequency band of operation of the invention. The primary feedhorn assembly is embodied as a dual-mode hybrid Tee which permits azimuth-plane monpulse sum and difference antenna patterns to be formed thus improving the azimuth accuracy of the system. The dual channel rotary joint 38 connects the two ports of the hybrid Tee primary feed to the transmitter and receiver package 40 which is located as illustrated in FIG. 4. A motor/tach drive assembly 42 is connected to the rotary joint 38 for providing mechanical drive.

Figure 5:
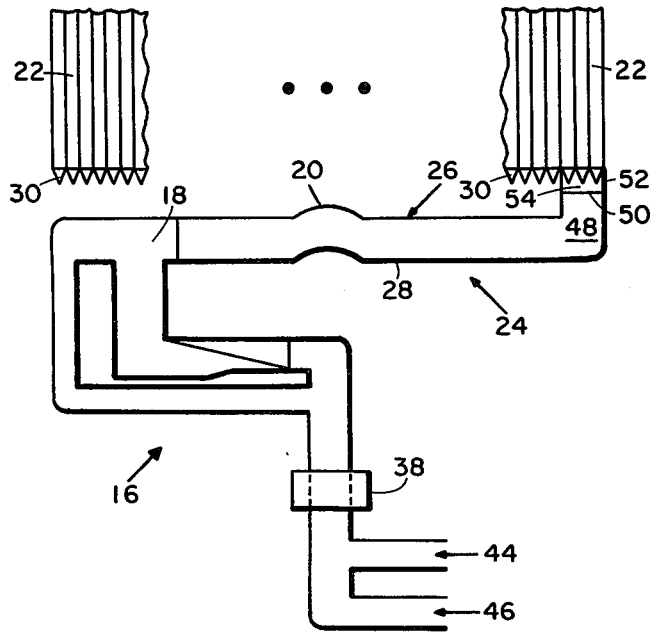
FIG. 5 is a side view of the antenna feed system of the present invention illustrating the geodesic lens and the dielectric coupling wedges.

Referring to FIG. 5 there is illustrated a partial cross section of the rotating primary feed assembly 16 and the rotary joint 38 having sum and difference ports 44 and 46. As seen in FIG. 5 the primary feed assembly includes the geodesic lens 20 and is formed in the parallel plate structure 24 including the top plate 26 and the lower plate 28. Preferably, the parallel plate structure 24 is embodied as a closed structure having metallic sidewalls for rigidity. Alternatley, the parallel plate structure 24 could be embodied with open sides as would readily be understood by those of ordinary skill in this art. In the embodiment illustrated in FIG. 5, the metallic sidewall 48 of the parallel plate structure 24 is terminated at 50 leaving the section 52 of the parallel plate structure 24 with no sidewalls. As is further illustrated in FIG. 5, the dielectric 30 which fills each of the waveguide elements of the waveguide array 22 is extended out of the waveguide in the form of a wedge. These wedges 30 are then placed within the parallel plate structure 24 within the region 52. The wedges 30 create an impedance match between the parallel plate region 24 and the dielectrically loaded waveguide elements 22. In this manner the rotating primary feed assembly 18 is electromagnetically coupled to the radiating antenna elements 22 and at the same time is free to rotate.

Figure 6:
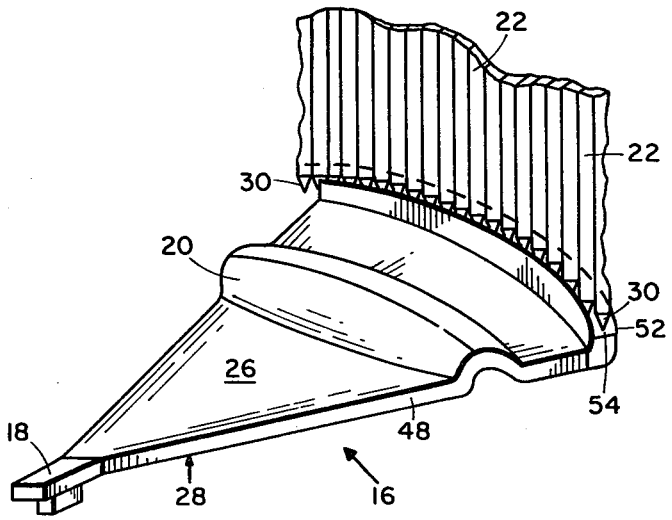
FIG. 6 is an isometric view of an H-plane sectoral horn in accordance with the present invention.

Referring to FIG. 6 there is illustrated an isometric view of a portion of the primary feed assembly 16. The primary feed assembly 16 includes a hybrid Tee feedhorn which feeds the parallel plate structure 24. The parallel plate structure 24, as previously described comprises parallel plates 26 and 28. The sidewalls 48 of the horn diverge from the center of the Tee 18 to the aperture 54. Located in the horn flare region is the geodesic fold or lens 20 which serves to collimate the energy coming out of the sectoral horn and provides phase delay compensation. Other collimating devices such as a dielectric lens or a metal plate lens could be used for 20 in place of the geodesic lens. As is seen in FIG. 6 the dielectric wedges 30 extend within the aperture portion 54 of the parallel plate structure and are extended from the dielectric material filling the waveguide antenna elements 22 to provide a transition between the feed assembly 16 and the radiating antenna elements 22. In this manner the energy from the feed assembly 16 is coupled into the extended dielectric and thence into the waveguide antenna elements 22. It is to be understood that only a sector of the cylindrical array formed by the waveguide elements 22 and wedges 30 are illustrated in FIG. 6 for purposes of simplicity. As illustrated in FIG. 6, moreover, it is apparent that the feedhorn assembly 16 is free to rotate past the stationary wedges 30 and waveguide antenna elements 22.

To reiterate the operation of the device as described, energy enters from the hybrid Tee 18 into the parallel plate structure 16 in which a geodesic lens 20 is located. The lens 20 converts the spherical wave from the hybrid Tee 18 into a plane wave by providing phase compensation. This plane wave travels through the remainder of the parallel plate region and is channeled through aperture 54 in the parallel plate region through dielectric wedge transitions 30 into the bottom of the dielectrically-loaded rectangular waveguides 22 that make up the cylindrical surface. The radiating aperture of the antenna consists of the slots 32 cut in the broadwall of the rectangular waveguides. The collimated line source inside the parallel plate region is transformed into a two-dimensional plane wave just outside the cylinder. Each waveguide is terminated at its upper end with a coaxial load 34. It is noted at this point that the coaxial loads 34 prevent a secondary beam from being formed due to reflection from the other waveguides.

The waveguide array 22 and the dielectric wedges 30 as illustrated in FIGS. 3 and and 5 are stationary. The parallel plates 26 and 28, the geodesic horn 20 and the rotary joint 38 all rotate as a unit. This rotation scans the antenna beam in azimuth. Elevation scanning of the beam is accomplished by changing the frequency of the transmitter 40.

Obviously, many other modifications and variations of the present invention are possible in the light of the above teachings. It is therefore to be understood that within the scope of the appended claims the invention may be practiced otherwise than as specifically described.

What is claimed is:

1. A waveguide antenna assembly for providing selective scanning of an electromagnetic energy beam comprising:

a plurality of waveguides disposed with respect to each other so as to form a cylindrical waveguide radiating array structure having an interior cylinder surface and an exterior cyliner surface, each of said plurality of waveguides having means for radiating electromagnetic energy out from said exterior cylinder surface;

means for selectively scanning said electromagnetic energy beam in azimuth over a range of 360° comprising a rotating primary feed horn assembly positioned within the interior of said cylindrical waveguide radiating structure for selectively illuminating each of said waveguides of said structure with electromagnetic energy such that rotation of said rotating primary feed horn assembly results in a change of azimuth of said electromagnetic energy beam.

2. The waveguide antenna assembly of claim 1 further comprising:

a dielectric wedge positioned within each of said plurality of waveguides, each said wedge being for electromagnetically coupling one of said plurality of waveguides to said rotating primary feed horn.

3. The waveguide antenna assembly of claim 1 wherein said rotating primary feedhorn assembly comprises a parallel plate structure.

4. The waveguide antenna assembly of claim 3 further comprising:

a geodesic lens positioned within said parallel plate structure.

5. The waveguide antenna assembly of claim 4 wherein said parallel plate structure comprises an H-plane sectoral horn for providing phase delay compensation.

6. The waveguide antenna assembly of claim 2 wherein each of said plurality of waveguides is filled with a dielectric.

7. The waveguide antenna assembly of claim 1 wherein said means for radiating electromagnetic energy comprises at least one radiating slot.

8. The waveguide antenna assembly of claim 1 wherein said plurality of waveguides are disposed with their broadwalls forming said exterior cylinder surface.

9. The waveguide antenna assembly of claim 1 wherein said plurality of waveguides are disposed with their narrow walls forming said exterior cylinder surface.

10. The waveguide antenna assembly of claims 1, 2, 3, 4, 5, 6, 7, 8 or 9 further comprising a waveguide load at one end of each of said plurality of waveguides.

11. The waveguide antenna assembly of claim 2 wherein:

each of said plurality of waveguides has a first end and a second end; and each of dielectric wedges extends outwardly beyond said second end of the corresponding one of said plurality of waveguides.

12. A waveguide antenna assembly for providing selective scanning of an electromagnetic energy beam comprising:

a plurality of waveguides disposed with respect to each other so as to form a cylindrical waveguide radiating array structure having an interior cylinder surface and an exterior cylinder surface, each of said plurality of waveguides having means for radiating electromagnetic energy out from said exterior cylinder surface, each of said plurality of waveguides comprising a section of straight waveguide and each of said plurality of waveguides having a first end and a second end;

a rotating primary feed horn assembly positioned within the interior of said cylindrical waveguide radiating structure and further positioned with respect to the said second ends of said plurality of sections of straight waveguides so as to couple energy directly into said second ends of said straight waveguides whereby the rotation of said rotating primary feed horn assembly results in a change of azimuth of said electromagnetic energy beam.

* * * * *